US007911146B2

(12) United States Patent
Dunn-Rankin et al.

(10) Patent No.: US 7,911,146 B2
(45) Date of Patent: Mar. 22, 2011

(54) HIGH-VELOCITY, MULTISTAGE, NOZZLED, ION DRIVEN WIND GENERATOR AND METHOD OF OPERATION OF THE SAME ADAPTABLE TO MESOSCALE REALIZATION

(75) Inventors: Derek Dunn-Rankin, Irvine, CA (US); Matthew J. A. Rickard, Camarillo, CA (US)

(73) Assignee: The Regents of the University of California, Oakland, CA (US)

( * ) Notice: Subject to any disclaimer, the term of this patent is extended or adjusted under 35 U.S.C. 154(b) by 1294 days.

(21) Appl. No.: 11/444,557

(22) Filed: May 31, 2006

(65) Prior Publication Data

US 2007/0277667 A1 Dec. 6, 2007

(51) Int. Cl.
*H05B 31/26* (2006.01)

(52) U.S. Cl. ..... 315/111.91; 315/111.81

(58) Field of Classification Search ..... 315/111.31, 315/111.81, 111.91
See application file for complete search history.

(56) References Cited

U.S. PATENT DOCUMENTS

| | | | | |
|---|---|---|---|---|
| 3,582,694 | A * | 6/1971 | Gourdine | 310/10 |
| 4,380,720 | A * | 4/1983 | Fleck | 315/111.91 |
| 4,789,801 | A * | 12/1988 | Lee | 310/308 |
| 5,180,404 | A * | 1/1993 | Loreth et al. | 96/56 |
| 6,486,483 | B2 * | 11/2002 | Gonzalez | 250/526 |
| 2005/0034464 | A1 * | 2/2005 | Gonzalez | 60/801 |
| 2005/0205430 | A1 * | 9/2005 | Thompson | 205/170 |

* cited by examiner

*Primary Examiner* — Douglas W Owens
*Assistant Examiner* — Minh D A
(74) *Attorney, Agent, or Firm* — Marcus C. Dawes; Daniel L. Dawes

(57) ABSTRACT

Gas flows of modest velocities are generated when an organized ion flux in an electric field initiates an ion-driven wind of neutral molecules. When a needle in ambient air is electrically charged to a potential sufficient to produce a corona discharge near its tip, such a gas flow can be utilized downstream of a ring-shaped or other permeable earthed electrode. In view of the potential practical applications of such devices, as they represent blowers with no moving parts, a methodology for increasing their flow velocities includes exploitation of the divergence of electric field lines, avoidance of regions of high curvature on the second electrode, control of atmospheric humidity, and the use of linear arrays of stages, terminating in a converging nozzle. The design becomes particularly advantageous when implemented in mesoscale domains.

18 Claims, 12 Drawing Sheets

HIGH-VELOCITY, MULTISTAGE, NOZZLED, ION DRIVEN WIND GENERATOR AND METHOD OF OPERATION OF THE SAME ADAPTABLE TO MESOSCALE REALIZATION

GOVERNMENT RIGHTS

The invention was supported in part with government funds pursuant to NASA contract NNC04GA-28G. The Government has certain rights.

BACKGROUND OF THE INVENTION

1. Field of the Invention

The invention relates to the field of ion driven wind or gas generators and in particular to designs capable of operating in mesoscale implementations.

2. Description of the Prior Art

The physics of the ion-driven wind is reasonably well established. When an electric field acts on ions or other charge carriers dispersed in air, the body force on a unit volume of the gas, $\vec{F}$, is equal to that on the charges it contains, provided that they have a constant mobility and do not accelerate. Thus $$\vec{F}=\vec{E}e(n_-+n_+) \tag{1}$$

and the local current density, $$\vec{j}=\vec{j}_++\vec{j}_-=(K_+n_++K_-n_-)\vec{E}e, \tag{2}$$

where $\vec{E}$, e, n, K represent electric field, fundamental charge, number density and mobility respectively, and the sign in the suffix denotes the polarity. When the charge cloud is unipolar, or when charge carriers of both polarities are present, but the mobility of one is much greater than that of the other (e.g. electrons and ions, or ions and charged particles) the distribution of body force and consequent pressure gradients results in gas flow. Because of the high potentials generally involved, unipolar clouds are the norm in regions between the relatively small zone of a corona glow ion source and a remote electrode, so long as the field does not reach magnitudes large enough to cause secondary ionization and electrical breakdown of the neutral gas. Thus equation (1) becomes $$\vec{F}_\pm=\vec{E}e(n_\pm) \tag{1a}$$

and equation (2) becomes $$\vec{j}=(K_\pm n_\pm)\vec{E}e \tag{2a}$$

so that $$\pm\vec{F}=\vec{j}/K_\pm. \tag{3}$$

It follows that, irrespective of the geometry, the body force on the gas and hence the potential to induce velocity is boosted by increasing current density and by decreasing mobility, i.e., utilizing charge carriers which exercise the highest drag on the neutral gas.

The wind generated by ion drag has been termed "corona", "electric", "ionic" (chiefly with flames as ion sources), or "electrohydro-dynamically induced", where the latter term has appeared more recently in application-based studies, i.e. electrostatic precipitation, enhanced drying, and flow control. To emphasize that the gas motion is bulk neutral gas flowing as a result of electric forces acting on ions, the term "ion-driven" wind is used in this disclosure.

Although the first documentation of ion-driven wind occurred in 1709, the first in-depth analysis of the phenomenon was conducted almost 200 years later. There have been numerous studies concerning the use of ion-driven wind velocities for a variety of aerodynamic, heat transfer, and other applications, all of which would benefit from maximizing the gas velocities. Examples include silent mass transfer in low flow (fan-less) electrostatic precipitators U.S. Pat. No. 4,789,801 (1988), flow control, heat transfer, enhanced drying, and combustion control. Much of the work in combustion and some in microgravity were based on using flame ions.

BRIEF SUMMARY OF THE INVENTION

The illustrated embodiment of the invention is an apparatus for generation of ion driven wind comprising a plurality of ion driven wind generator stages, each coupled to each other in series, the plurality of ion driven wind generator stages having an inlet and an outlet; and a nozzle communicated to the outlet.

The plurality of ion driven wind generator stages include in each stage a sharp axial electrode and a smooth at least partially coaxial ground electrode. In the illustrated embodiment the plurality of ion driven wind generator stages each comprise a tube housing and where the ground electrode is a ring electrode disposed in or on the tube housing.

The ring electrode has an inner surface flush with an inner surface of the tube housing and the ring electrode comprises a flush axial extension of the tube housing.

A gap distance is provided between the axial electrode and ground electrode. The gap distance is approximately equal to the diameter of the tube housing.

Each axial electrode has a pin point and each axial electrode is completely insulated except for the pin point.

In one embodiment the plurality of axial electrodes have an alternating voltage polarity applied to them. Each axial electrode has a corresponding upstream coaxial electrode, and each axial electrode is maintained at the same voltage polarity as its corresponding upstream coaxial ground electrode. The negative voltage source is coupled to the axial electrode. The voltage source provides the highest potential that can be achieved without electrical breakdown.

In general, the only limitation is that the axial electrode have a potential difference relative to the coaxial electrode which is near breakdown. The sign of the difference or the polarities of the electrodes relative to ground is not relevant to whether or not an ionic wind is produced between the electrodes. Thus, the invention contemplates any absolute level of the voltages as might be desired relative to ground and any polarity difference from stage to stage as long as the potential difference within each stage is near breakdown.

The illustrated embodiment further comprises a source of low humidity air coupled to the plurality of stages.

The plurality of stages are fabricated in a plurality of mesoscale layers in which the grounded electrode and axial electrode a defined. For the purposes of this specification a mesoscale flow or mesoscale apparatus is defined as an apparatus where the relevant fluid has a low Reynolds number, e.g. below approximately 500, and the largest relevant size of the subject aspect of the apparatus which affects flow is small, namely of the order of 1 cm or smaller. The Reynolds number is defined by $\rho vL/\mu$ where $\rho$ is the fluid density, $\mu$ is the fluid viscosity, L the characteristic length scale of the system and v the velocity of the fluid. The Reynolds number represents the ratio of the momentum forces to viscous forces. In qualitative terms the mesoscale is the range where the wall drag on the fluid causes a substantial pressure drop relative to the fluid momentum. In a large pipe, the momentum of the fluid flowing through it at any point is quite high relative to the drag force exerted at the walls, where in contrast at the mesoscale there is a closer match between these two.

The plurality of mesoscale layers comprise an upper and lower conductive ground layer, and an upper and lower insulative channel layer disposed adjacent to the upper and lower conductive ground layer respectively. The upper and lower insulative mesoscale channel layer define an axial channel in which a plurality of mesoscale openings communicating the axial channel to the upper and lower conductive ground layers are defined. A middle conductive electrode layer disposed adjacent to the upper and lower insulative channel layers in which middle conductive electrode layer a corresponding plurality of mesoscale chambers are defined and into which an integrally formed mesoscale point electrode axially extends.

The illustrated embodiment also includes the method of operating the apparatus described above and the method of fabricating the apparatus as a mesoscale device.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

Figure 1:
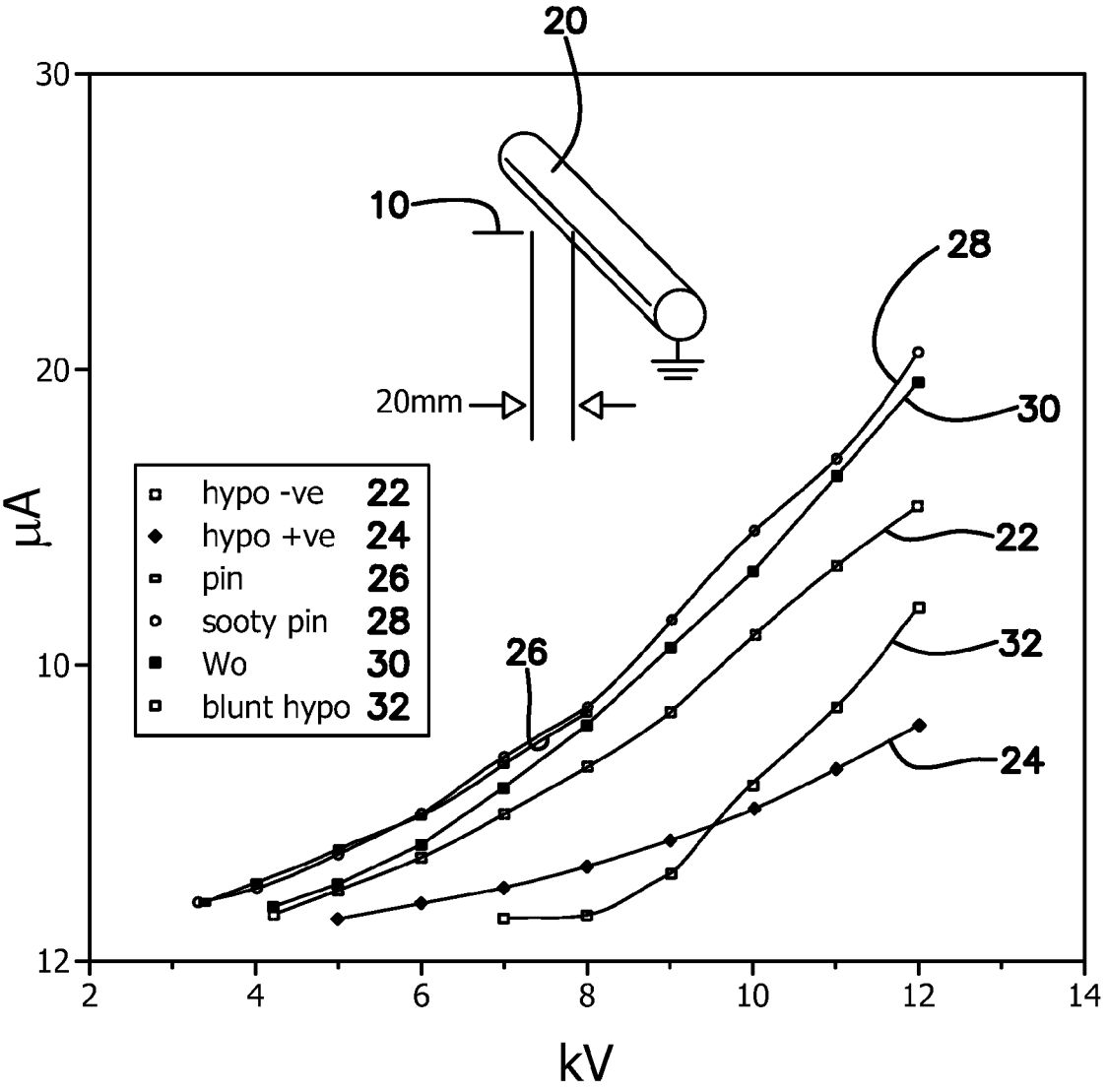
FIG. 1 is a graph of the corona current as a function of the potential applied to various pointed electrodes.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

The present disclosure is directed to the use of coronas from points of high curvature as ion sources used as ion driven wind generators. Here the rate of charge generation continues to increase with the local field strength, as distinct from reaching a saturation value as occurs in a flame, and the potential difference required to produce a particular current has a direct bearing on the efficiency of the process. The maximum ion-driven wind velocities attainable from corona-based systems are limited, therefore, by both electrical and aerodynamic constraints.

The principal electrical limitation is due to secondary ionization and breakdown at the second electrode, which is generally the earth or ground. This creates free charges of the opposite polarity near its surface and their counter-flow tends to neutralize the space charge flux and hence the body force and flow velocity. The field increases with distance from the relatively small region of the corona ion source due to the unipolar charge cloud, as given by Gauss's law. Thus, for a one-dimensional system, in which a large planar ion source, which is approximated, for example, by a flat "brush" of pinpoints, is faced by a large planar electrode, the planes being perpendicular to the distance co-ordinate, x, Gauss's law becomes:

$$\frac{dE}{dx} = \frac{1}{\varepsilon_0}(n_+ - n_-)e \tag{4}$$

i.e.

$$\frac{dE}{dx} = \frac{1}{\varepsilon_0}n \pm e = \frac{1}{\varepsilon_0 KE} \tag{5}$$

for a unipolar charge cloud, which integrates to $$E^2 - E_0^2 = 2jx/\epsilon_0 K, \tag{6}$$

where $E_0$ is the field at the corona ion source and $\epsilon_0$ is the permittivity of free space. Hence the maximum prebreakdown current density is $$j_{max} = (E_b^2 - E_0^2)\epsilon_0 K/2x, \tag{7}$$

where $E_b$ is the breakdown field at the electrode. Such considerations suggest avenues for maximizing ion-driven wind velocities by minimizing electrical limitations.

First, the maximum current density depends on $E_b^2$, so much is to be gained by increasing the breakdown field at the electrode. Avoiding regions of high curvature on the second electrode is perhaps the most obvious step in designing the geometry.

Exactly the opposite strategy is required at the pointed electrode, to maximize current for a given potential. The current/potential characteristics of different corona electrodes affect not only the efficiency of the process but also the maximum current through the $E_0$ required to produce the particular j, as given by Eq. (7). Since the discharge cascade is initiated by electrons, a negative potential on the corona electrode requires less potential difference for a given current than does a positive corona.

Note also the consequence of the proportionality to K in Eq. (7) on maximizing wind velocities. The advantage of using large charge carriers, which exercise the highest drag on the neutral gas because of their low mobility (Eq. (3)), is cancelled out by their effect on $j_{max}$. Thus there is no point in using, for example, very low mobility charged particles to achieve the highest velocities.

Furthermore, the breakdown field is approximately proportional to pressure, is inversely related to absolute temperature, and varies greatly from one gas to another. Thus, highly electronegative gases have very high breakdown strengths, e.g., $E_0$ for $CCl_2F_2$ is about 5.6 times that for $N_2$, implying maximum ion-driven wind velocities more than 30 times greater; not allowing for changes in ion mobility. In practice, there is usually little scope for substantial variations in these parameters, with the exception of atmospheric humidity, which has a surprisingly large effect. It is probably the main cause of day-to-day variability in measured maximum ion-driven wind velocities. The results, for example, for a rod-plane system at 0.3 m separation imply that the breakdown (sparking) voltage, $V_b$, may be represented by $$V_b = 350 - 12.5h, \tag{8}$$

where $V_b$ is in kV, h is the absolute humidity in g/m$^3$, and the measurements cover the interval $0 \leqq h \leqq 15$. The implication is that drying air at 25° C. from 40% to zero relative humidity can increase the breakdown field by 56%. This compares with a 3% increase due to a variability of 10° C. in laboratory temperature. By contrast, the potential at the onset of the corona discharge is not greatly affected by moisture.

After avoiding sharp edges at the ground electrode, we next encourage divergence of field lines in order to lessen space charge and to prevent the build-up of field strength with distance. In practice, the ion concentration is so large near the corona needle tip that charge self-repulsion creates a rapidly diverging field that in the near-field is relatively insensitive to the ground electrode geometry. A one dimensional system is in any case difficult to achieve because a solid planar second electrode would be unsuitable for maximizing ion-driven wind velocities and a ring electrode used with a single point corona will always result in some lateral motion of the space charge. The relevant equations and maxima for spherically and cylindrically divergent fields have been published in the open literature, but here we are interested in unidirectional ion driven wind velocities, i.e., in what velocity can be achieved in tube-confined flow. Because space charge complicates the situation somewhat, particularly near a corona needle, a comprehensive treatment here of the divergence for all of the possible geometric shapes, sizes, and positions of electrodes would be intractable. Therefore, except for the study of the corona electrode described in the following paragraph, in this disclosure a ring electrode shaped for minimum drag and maximum breakdown field is selected and our study of divergence is specific to this geometry.

Throughout this part of the disclosure, the high potentials derived from electronic high tension (E.H.T.) Brandeburg Regulated Power Supplies units, variable up to 30 kV and fitted with integral voltmeters. Currents were measured using a microammeter (Universal Avometers). It has been reported that, for a negative point-plane corona at voltages near breakdown, the current pulsates rapidly, in which case our microammeter would record averages, since its time response was too slow to follow these fluctuations.

In these experiments, our interest was in corona electrode performance, and hence we used a rod as the second electrode to avoid any edge-induced potential breakdown at the ground. Initially we used fine hypodermic syringe needles (0.5 mm external diameter, ground at an oblique angle) for the corona electrodes, on the assumption that they would provide the sharpest points. This proved not to be the case, as the comparison with various other corona electrode points show in the graph of FIG. 1. The earth electrode 20 was a smooth cylindrical rod of large diameter placed horizontally, at right angles to the needle 10, at a distance of 20 mm from the point. A large number of alternative corona discharge electrodes 22-32 were studied, using various points, metals and coatings. The current/voltage characteristics of some of these are shown in FIG. 1, where "hypo" stands for the hypodermic syringe needles 22, 24 described above, "blunt" for a hypodermic syringe needle 32 whose point had been cut away, "sooty" for "coated with soot" 28 and "Wo" for a tungsten rod 30 ground to a fine point. The tungsten needle 30 could also be transiently heated, to reduce its work function further. With the exception of "hypo +ve" 24, all the points were held at a negative potential.

It will be seen that pins (commercial dressmakers', or safety pins) are marginally preferable, though the major disadvantages arise only from applying a positive potential and from reducing the points' curvature. The plasmas are maintained by the Townsend field. The source of the electrons, which attach to become the negative ions used in the negative corona discharges, is the avalanche of electrons that maintains the process by photo-ionization of the gas molecules due to the UV radiation from the corona glow itself. A side effect of this process is that negative coronas produce significantly more ozone than do positive coronas. In cases where generation of ozone is an environmental or health concern a conventional ozone filter can be combined with the apparatus to reduce or eliminate ozone emissions.

Figure 2:
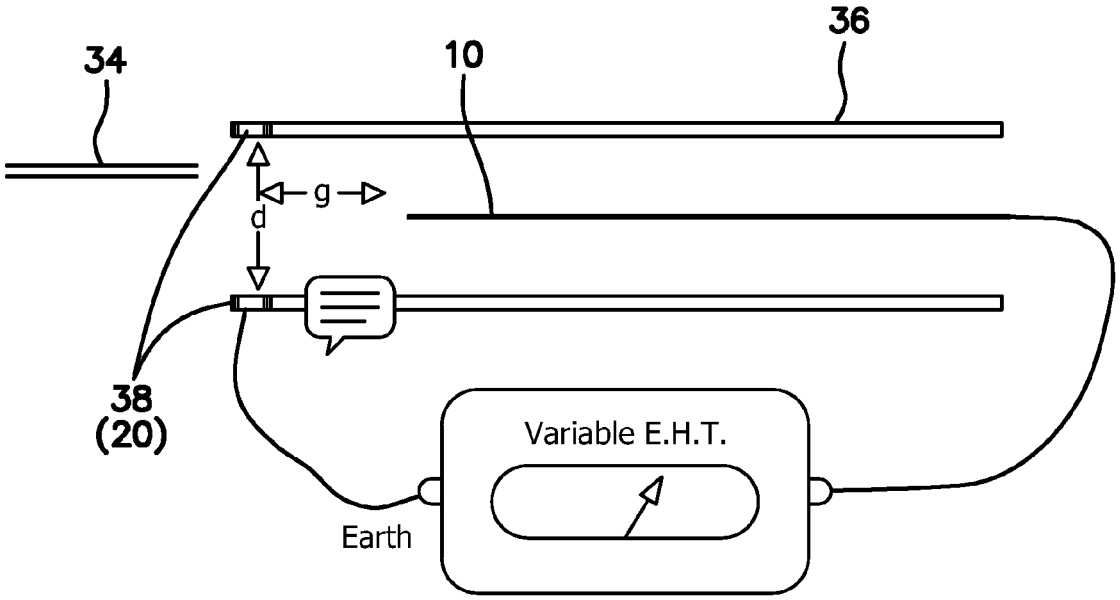
FIG. 2 is an experimental set up for measuring the effect on ion-driven wind velocities of earth electrode geometry and field divergence.

As diagrammed in FIG. 2 the distributions of local ion-driven wind velocities were measured using Pitot microtubes 34 linked by a length of insulating tubing to a micromanometer (Furnace Control Ltd.) (not shown). The tubes 34 were glass capillaries of 0.5 mm internal and 1 mm external diameter and they were generally used beyond the regions of electric field and ion space charge. In all cases the maximum ion-driven wind velocities were recorded at a potential such that any further increases would result in the onset of a breakdown discharge at the earth electrode, accompanied by a decrease in velocity. Clearly in the case where the object is to generate air or fluid flow, any type of Pitot tube or measurement device will be omitted.

The system used to study the effects of the earth electrode geometry and field divergence is illustrated in the diagram of FIG. 2. Measurements were carried out in 15 and 25 mm internal diameter (d in FIG. 2) tubes 36. Initially, thin metal foil rings 38 attached to the inside of the tube 36 were used as earth electrodes. However it was found that the arrangement shown in FIG. 2 of attaching a smooth metal ring 38 of the same width as the tube 36, with adhesive, so that it was mounted flush as a 2 mm extension to the tube 36, delayed breakdown and yielded higher velocities. The effect of field divergence was investigated by varying the electrode gap, g, between the pin 10 and ground electrode 38 (20).

Figure 3A:
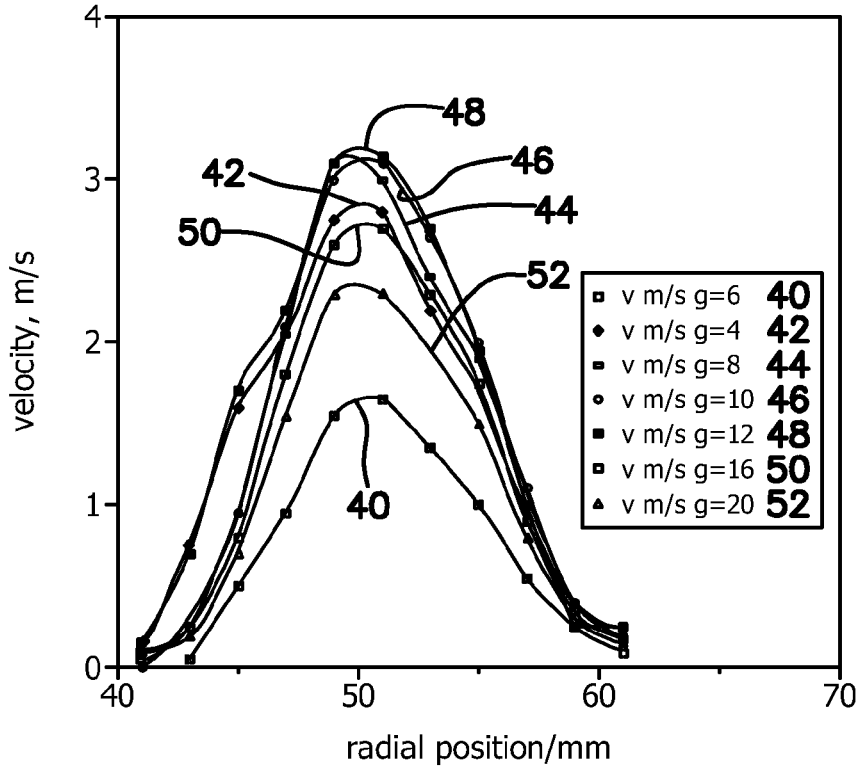
FIG. 3*a* is a graph of the radial profile of axial velocities for various electrode separations, g. The origin of the radial coordinate is arbitrary; g is given in mm.
Figure 3B:
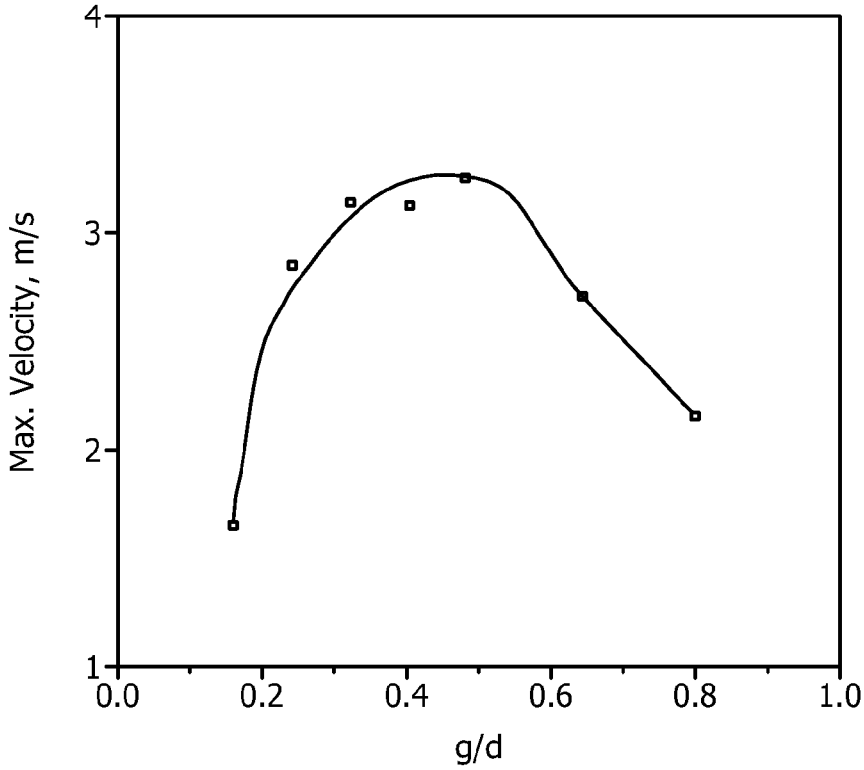
FIG. 3*b* is the maximum velocity as a function of the electrode separation-tube diameter ratio.

Results in the 25 mm diameter tube are shown in the graph of FIG. 3*a*. The velocities are components in the axial direction of tube 36. The central maxima are plotted against the ratio of the electrode gap, g, to the tube diameter in FIG. 3*b*. The curve manifests a rather flat maximum but it does occur close to the 0.5 value where the electrode separation is equal to the tube radius, corresponding to the spherical divergence case. The results for the 15 mm diameter tube were similar.

It was observed that expulsion of breath anywhere near the air intake caused instant breakdown at any appreciable potential. The increase in humidity severely limited the maximum attainable ion-driven wind velocities. This also confirmed our suspicion that changes in atmospheric humidity were responsible for changing maximum wind velocities from day to day. Obtaining day-to-day consistency was important for generating data trends and understanding ion-driven wind behavior. Although the trends are repeatable, it is likely that accurate reproduction of the absolute experimental values presented in most atmospheric corona discharge studies is difficult. This is because subtle electrode variations (e.g., alignment, microscopic scratches or burs) and humidity can have substantial influence.

When the laboratory was provided with a continuously operating dehumidifier, the voltage at breakdown, the maximum current, and the maximum ion-driven wind velocities increased substantially. Also, the day-to-day variability in all the magnitudes was much reduced. The maximum axial velocity for the 25 mm diameter tube was 4.5 m/s and the volume flow almost a liter per second (typically 0.93 l/s).

It follows from Eq. (3) that the pressure head, Δp, driving the wind velocity in a one-dimensional system is the integral of j/k over the inter-electrode distance x. Hence the exit velocity (or rather the velocity increase, if the initial velocity is not zero), is given by $$\upsilon = \left[2\rho \int \frac{j}{k} dx - \Delta p_L\right]^{0.5}, \tag{9}$$

where $\Delta p_L$ is the pressure loss due to drag, at that velocity and k is mobility. The effect of such pressure losses have been formulated in detail for coronas and flame ions. However, all these prior art studies used various metal grids as earth electrodes. The earth electrodes flush with the tube walls as used in the disclosure offer much less resistance to the flow.

Nevertheless the pressure head is very small and the drag also involves entraining ambient gas since, for incompressible flow, the flow cannot accelerate without entrainment. It has been shown that a solid planar earth electrode induces a toroidal vortex, the axial flow towards its center tending to return around the periphery. As discussed earlier, the interaction between the charge carrier and the neutral gas is defined by its mobility, K, which represents its effectiveness as a virtual impeller. As K tends to zero, hypothetically, the charge carriers would tend to drive the neutral gas essentially as a piston. However, molecular ions are very small and have large mobilities. It offers some physical insight into the permeability of the ion cloud as a flow impeller to bear in mind that, while it moves in the direction of the field vector with an organized unidirectional velocity of the order of 103 m/s ($KE_b$) superimposed on its Maxwellian velocity distribution, only one in about $10^{10}$ molecules is an ion. These devices, therefore, behave much like fans, in that they can deliver a substantial volume flow only against negligible back pressures.

Unlike a fan, however, the flow output of an ion-driven wind generator is limited by the electrical breakdown between the charged electrode and the ground. In attempting to increase gas velocities, we explore generators staged in series and confined within a tube. By analogy to fans in series, we predict that each stage will contribute an equal total pressure rise, usable (in an ambient exit environment) either for overcoming flow loss or conversion to velocity. Since a monotonic relationship links mass flux and fan rotational speed, operating fans at identical speeds when staged in series will maximize the throughput. That is, if the tube cross-sectional area is constant and the air can be considered incompressible in subsonic flow, the same mass flux must pass each stage and, in the case of fans, unequal rotational speeds would cause inefficiencies. Similarly, the monotonic relationship between mass flux and electric field ensures that an identical field applied to each generator in the array will maximize the flow. Theoretically, the dynamic pressure gained by serial staging ion-driven wind generators is $$P_{dyn} = \Sigma\Delta p = n_a D_p, \tag{10}$$

where Δp is dynamic pressure obtained in a single stage and $n_a$ represents the number of stages.

Depending on geometry, the maximum exit velocity is limited by the back pressure or by electrical breakdown. Multi-stage ion-driven wind generators connected in series aggregate Δp but increase exit velocity only so long as the velocity-dependent back pressure does not become limiting. Beyond that point, the back pressure aggregates in step with the driving pressure and the velocity increase levels off. The accumulation of pressure losses is aggravated by the need for additional tube length to separate the stages sufficiently to avoid a reverse field (pin to preceding earthed ring). These reverse field losses can be ameliorated by insulating all but the pin-points of the corona needles. An effective alternative strategy is to alternate polarity so that each pin is of the same polarity and equipotential with the preceding ring. This allows pins to be attached to the preceding ring electrode, thereby shortening the system and decreasing wall losses, though there is some performance degradation arising from differences between positive and negative coronas.

Figure 4:
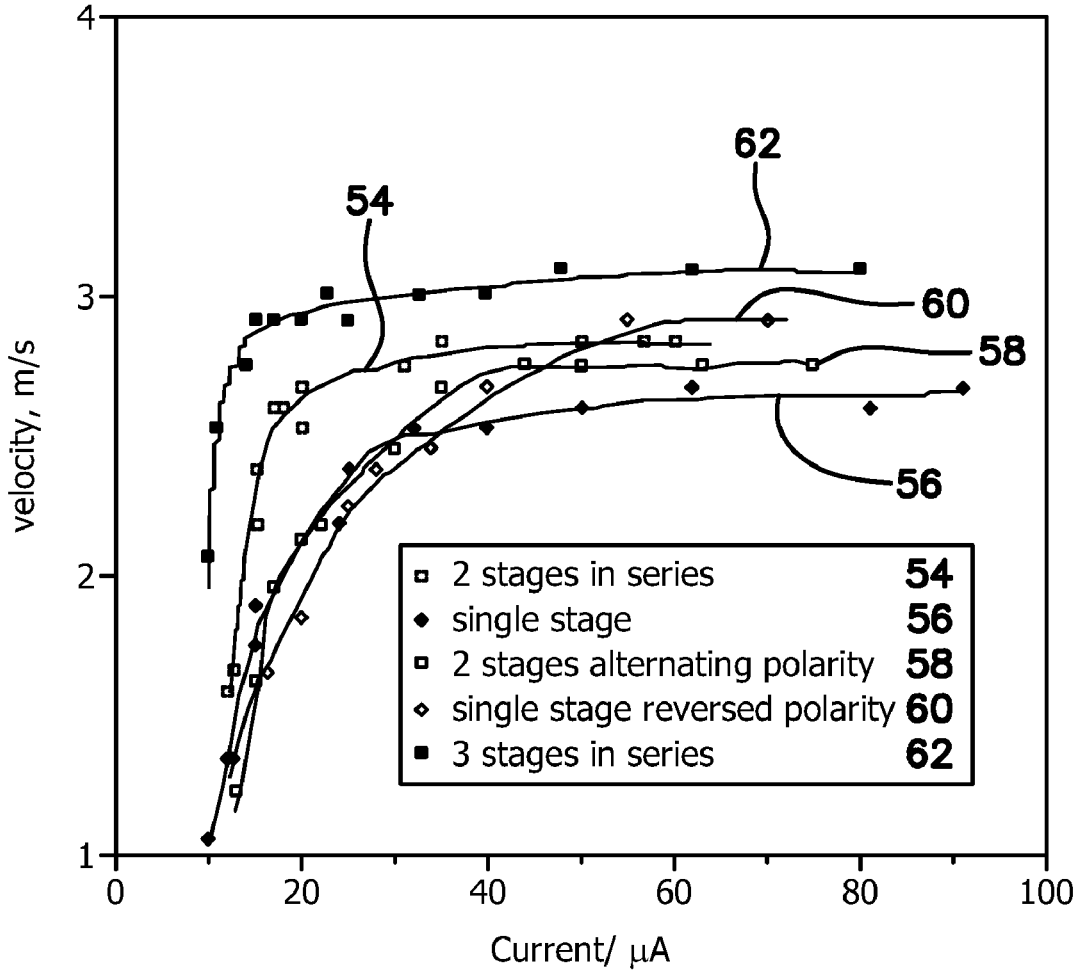
FIG. 4 is a graph of the central exit velocity as a function of current for 15 mm inner diameter, 120 mm-long tube for a single stage, two and three stages in series with different polarities.

FIG. 4 illustrates the situation where the maximum exit velocity is limited by the velocity-dependent back pressure in a long narrow tube. The tube diameter was 15 mm, the length (required to aggregate three stages) was 120 mm, the ring electrodes were of copper foil attached to the inside of the tube, and the exit velocity was measured centrally by a 2 mm inner diameter Pitot tube. At around 20 mA current, the effect of aggregating stages is still pronounced; at the maximum velocity it is small. Again in a commercial production unit there would be no need for and Pitot tube provided.

Figure 5:
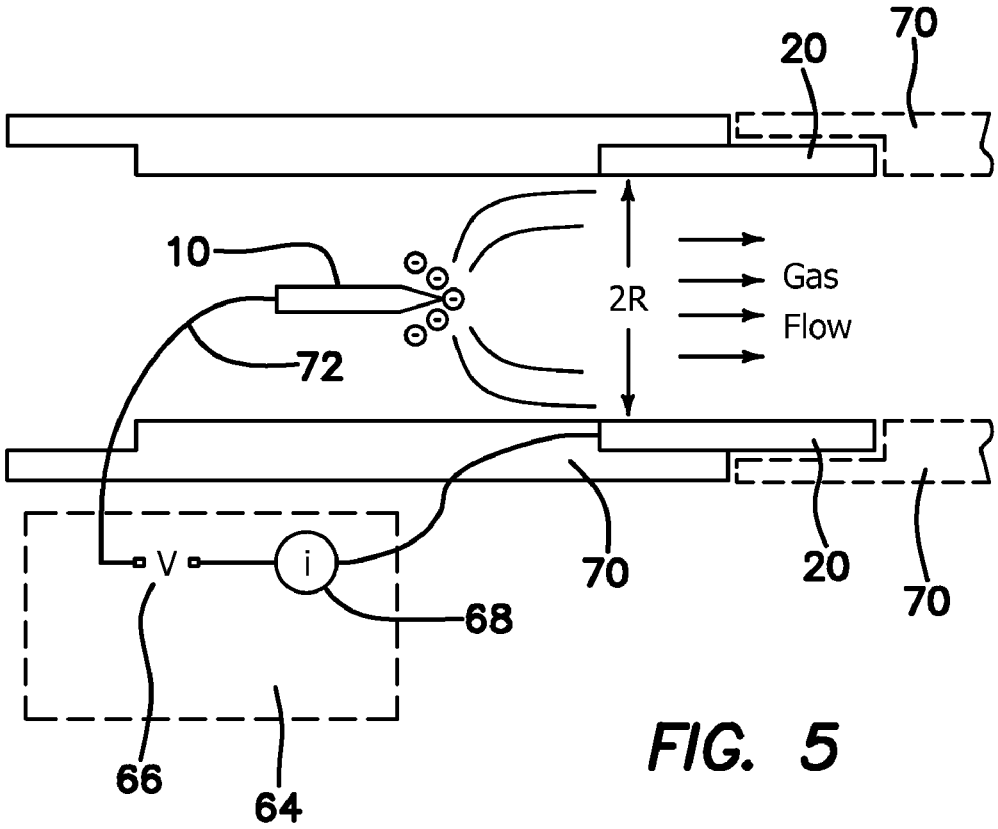
FIG. 5 is a side cross sectional diagram of a single stage generator that can be combined serially with like generators to provide a multistage system as shown in FIG. 6*a* or 6*b*.

Consider now the differences that result from some changes in the experimental system. In order to study aggregates of larger number of stages, a modular system was devised. In this alternate system, the variable high voltage power supply 64 (Glassman High Voltage, Inc., PS/EL30N01.5) provided potentials up to 18 kV (negative) to a needle 10 relative to a grounded ring 20, as shown in the diagram of FIG. 5. The power supply 64 provided digital readouts of both the applied voltage 66 and the system current 68; the latter was verified with an independent measurement of voltage drop across a large resistor. The velocities were measured using a vane anemometer 74 shown in FIG. 7 (Pacer Industries DA-40). As discussed above, $E_b$ and other results of corona-based experiments are notoriously dependent on the moisture content in the air. Therefore, constant laboratory relative humidity, measured using a Testo model 605-H1 hygrometer, was maintained at 50%±5%. The temperature was 23±1° C. for all measurements.

The apparatus is shown in FIGS. 5 and 6. A single stage comprised an acrylic housing or tube 70 (ID=25.4 mm and length of 38.1 mm where 33.3 mm is exposed to the flow), an acrylic needle mount (not shown), a needle 10, and a grounded copper ground tube 20 (ID=25.4 mm and L=17:8 mm). The needle 10 (body diameter=710 μm, tip diameter approximately 50 μm) came from a steel safety pin and was 17.8 mm long. As mentioned above, in order to keep a multistage system reasonably short, it was necessary to completely cover with shrink tubing the soldered joint where the rear of the needle connected to a high-voltage wire 72. This prohibited the air from producing a corona discharge at the rear of the needle 10, thus preventing it from generating a reverse field with the stage immediately upstream. The needle tip was 5 mm from the entrance plane of the copper ground tube 20. The breakdown voltage was −18 kV, and −15 kV was used for the experiments. The needle mount blocked one quarter of the flow area and it is this obstruction that caused the majority of the flow power loss. The blockage affected only the magnitude of the volumetric flow. The volume flow rate was measured for serial staged ion driven wind generators and the dynamic pressure, based on the mean velocity, is shown in FIG. 7.

Each stage contributes a static pressure rise, Δp, although, as discussed above, mass conservation prohibits the velocity from varying inside the constant area tube 70. This results in an increase in the stagnation pressure, $p_0$, such that the velocity (constant in the system) increases as $$v \alpha (\Sigma \Delta p)^{1/2}. \tag{11}$$

Figure 7:
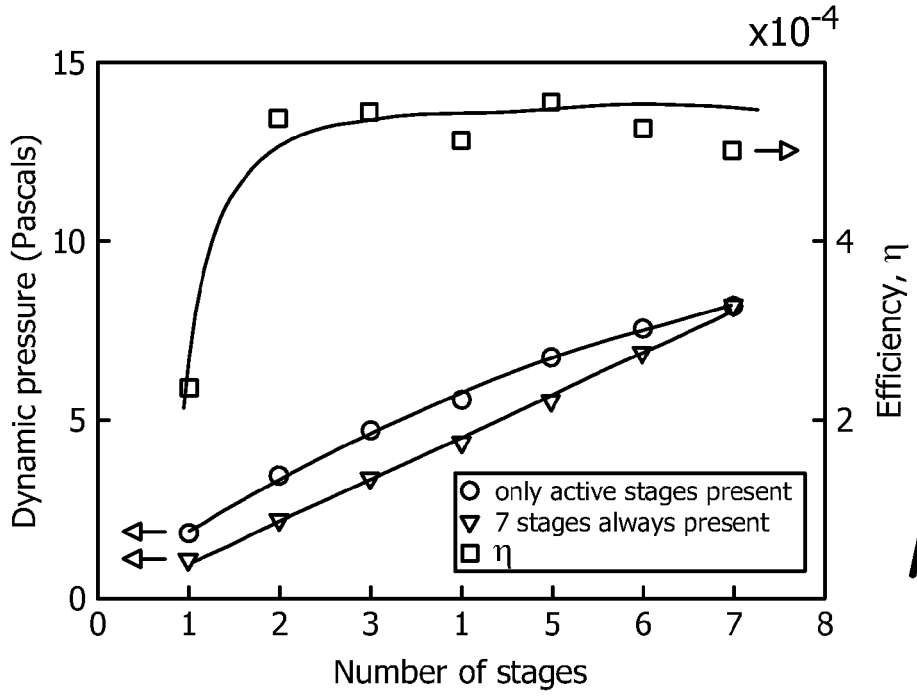
FIG. 7 is a graph which illustrates the flow reduction due to obstruction. Circles and squares represent the case when each stage is present only if electrically charged ("active"). Triangles illustrate level of flow when seven stages are always present (regardless of activation) and "Number of Stages" corresponds to number of active stages. Values of efficiency, $\eta$, are listed as a fraction.

The triangles in FIG. 7 show that dynamic pressure increases linearly with the number of stages, as Eq. (9) suggests. In this scenario, all seven stages are present, regardless of the number of stages active. The circles in the graph of FIG. 7 represent the case when the stage is present only if it is electrically charged. The latter scenario is unaffected by the friction loss of unused stages, and hence the dynamic pressure is higher (except for the seven-stage case when both scenarios are identical). The largest frictional loss comes from the flow area blockage of the needle mount. The tube 70 is smooth (acrylic), and since it is relatively short, the loss associated with the wall friction is small compared to that of the needle mount. The Reynolds number, Re, ranges from 3000 (one stage) to 6000 (seven stages), and hence, for flow loss considerations, it can be considered turbulent. The loss (dominated by the needle mount minor loss), $p_{fric}$, can be considered a fraction, f, of the dynamic pressure. Variation of f with Reynolds number can be ignored. In the theoretical case that the needle mounts could be removed, the pressure increase would be linear, following Eq. (8), where $n_a$ represents the number of stages active. The with-mounts case requires a description of the friction.

$$p_{fric} = n_p f p_{dya} \tag{12}$$

so that $$p_{dyn} = n_a D_p - n_p f p_{dyn}. \tag{13}$$

In the case that all seven stages are always present, $n_p$ is constant, along with f and Δp and a linear relationship results between $p_{dyn}$ and $n_a$. However, if only the active stages are present, $p_{dyn}$ depends on both the number of stages and on the friction loss, which itself depends on $p_{dyn}$ so that parabolic behavior is expected in agreement with the results in FIG. 7.

The use of an exit nozzle 76 increases velocity. In a staged ion-driven wind pump, the velocity through the core of a pump stage is limited, but the driving pressure head is not. That is, the aggregated total pressure difference is equal to ΣΔp, or nΔp, where n is the number of stages, if all contribute equally. This suggests a novel approach to increasing ion-driven wind velocities by aggregating pressure rises, using many stages and attaching a converging nozzle 76 at the exit. In addition to increasing the exit air velocity, the nozzles 76 in the experiment served as a calibration flow meter for the vane anemometer 74, where the velocity into the nozzle 76 was calculated from the nozzle inlet-to-exit area ratio and the measured pressure drop across it. Pressure measurements were made with a micromanometer (TSI DP-Calc). The nozzle meter calibration was itself verified by timing the inflation of a 5-gallon bag. The plastic nozzles had a fixed converging angle such that the inlet diameter of 65.5 mm was reduced to 21.5 mm at a distance downstream of 105 mm. All nozzles used this convergence ratio so nozzles of exit diameters larger than 21.5 mm are shorter than 105 mm. By loading the system with a converging exit nozzle, the flow can be accelerated, though the mass flux decreases. A nozzle produces little velocity increase in a single stage because the pressure drop caused by the restriction generally offsets any velocity gains. Furthermore, staging in the absence of an exit nozzle 76 provides little velocity improvement. However, velocity can be maximized by staging ion-driven wind generators (electric field just below breakdown) and loading the entire system with a converging exit nozzle 76. The decrease in exit area accelerates the fluid, and the staging provides sufficient driving pressure to overcome the pressure drop created by the nozzle 76.

Figure 6A:
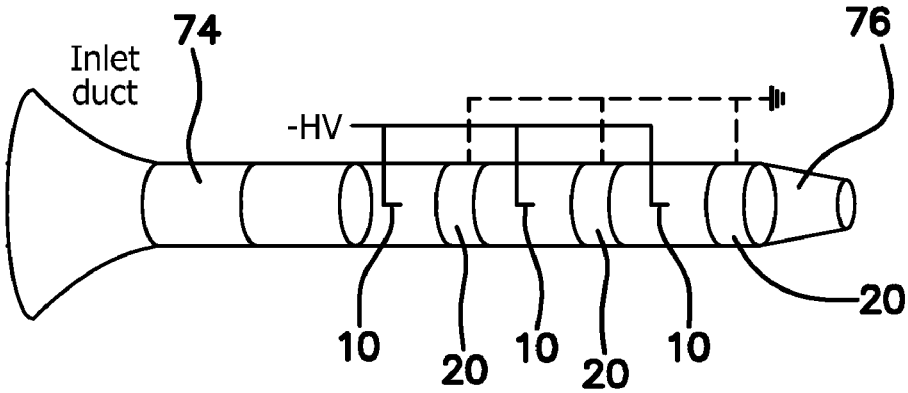
FIG. 6*a* is one embodiment of a multistage generator having a nozzled last stage output using a series of the single stage generators of FIG. 5 where the coaxial electrodes are all grounded and the axial electrodes coupled in common.

Experimental verification of the aggregated stage nozzle design, shown in FIG. 6*a*, was accomplished for six nozzle sizes (exit area in $cm^2$): 0.85, 1.59, 2.21, 2.85, 3.49, and 4.57. FIG. 6*a* is an embodiment where all the axial electrodes are coupled together and the coaxial electrodes are coupled to ground. Tests were also conducted with the system completely blocked (nozzle exit area 0.0) and completely open (5.07 $cm^2$). For a fixed number of stages, this experiment approximates the procedure used to characterize fans, where loading causes a decrease in flow and an increase in static pressure.

Figure 6B:
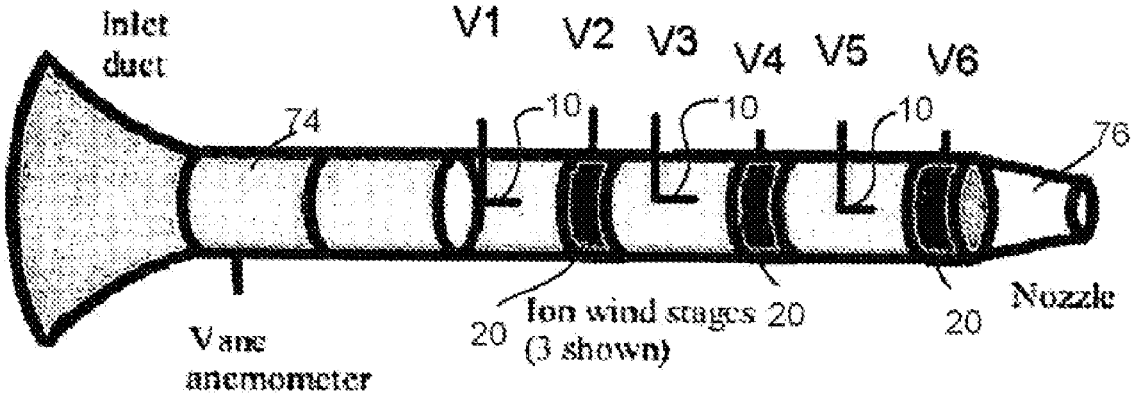
FIG. 6*b* is a multistage generator shown in a general case having a nozzled last stage output using a series of the single stage generators of FIG. 5 where the voltages applied to the coaxial and axial electrodes are each separately chosen as long as the voltage difference between the coaxial and axial electrodes is near the breakdown voltage.

FIG. 6*b* is an alternative embodiment which allows each axial and coaxial electrode to be provided with a potential at a different value and polarity, $V_1 \ldots V_6$, as long as the difference between the axial electrodes and downstream coaxial electrodes $V_1$-$V_2$, $V_3$-$V_4$, $V_5$-$V_6$, is near break down.

Figure 8:
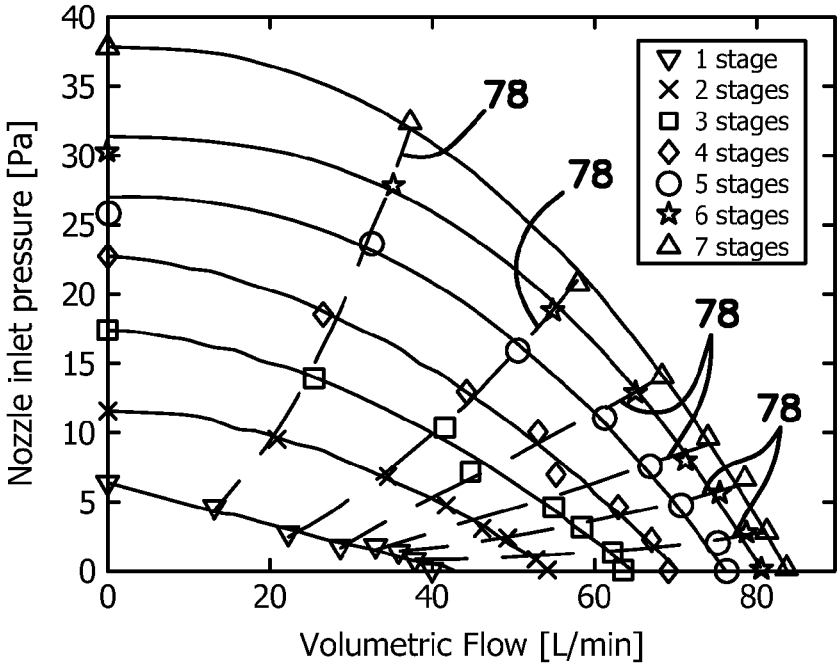
FIG. 8 are the characteristic curves for staged and nozzled ion wind generators of the illustrated embodiment.

For the ion-driven wind system, the static pressure increase at the nozzle inlet is plotted against the volume flow rate in the graph of FIG. 8. For the case of no nozzle (i.e., data along the horizontal axis), the data is equivalent to that shown in FIG. 7. The data along the vertical axis shows a linear increase in static pressure with number of stages. The dashed lines 78 represent the behavior of a particular nozzle and different numbers of stages, where the left most line 78 in FIG. 8 coincides with the smallest nozzle exit (0.85 $cm^2$).

Figure 9:
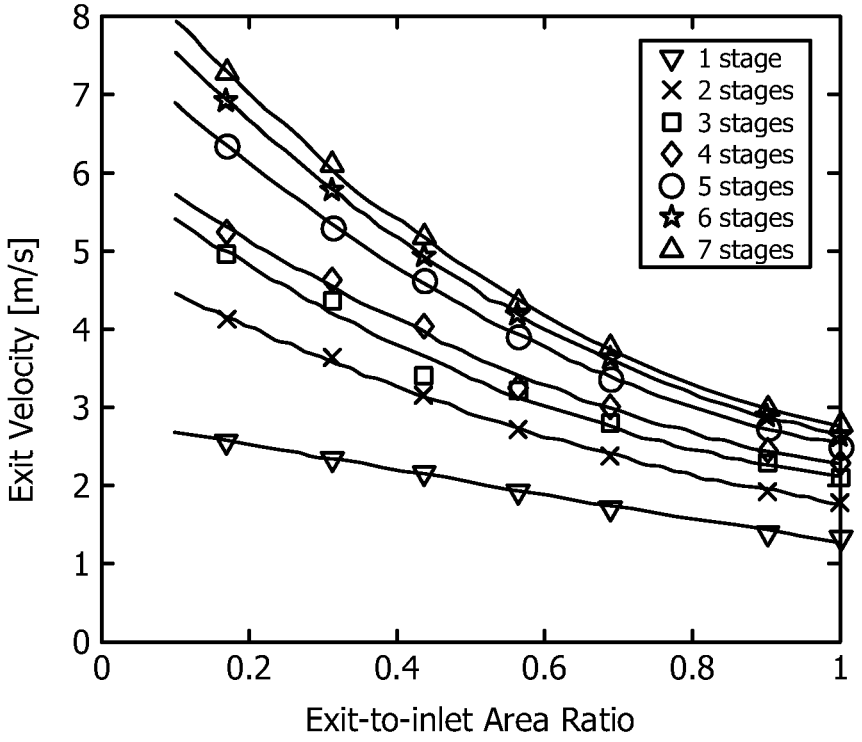
FIG. 9 is a graph of the mean velocity at the exit of the staged and nozzled ion wind generators of the illustrated embodiment.

FIG. 9 is a graph which shows the mean velocity at the nozzle exit plane, as calculated from the flow rate measurement and the area of the nozzle exit. An ion-driven wind faster than 7 m/s volumetric flow (mean) was achieved for our seven-stage system.

Figure 10:
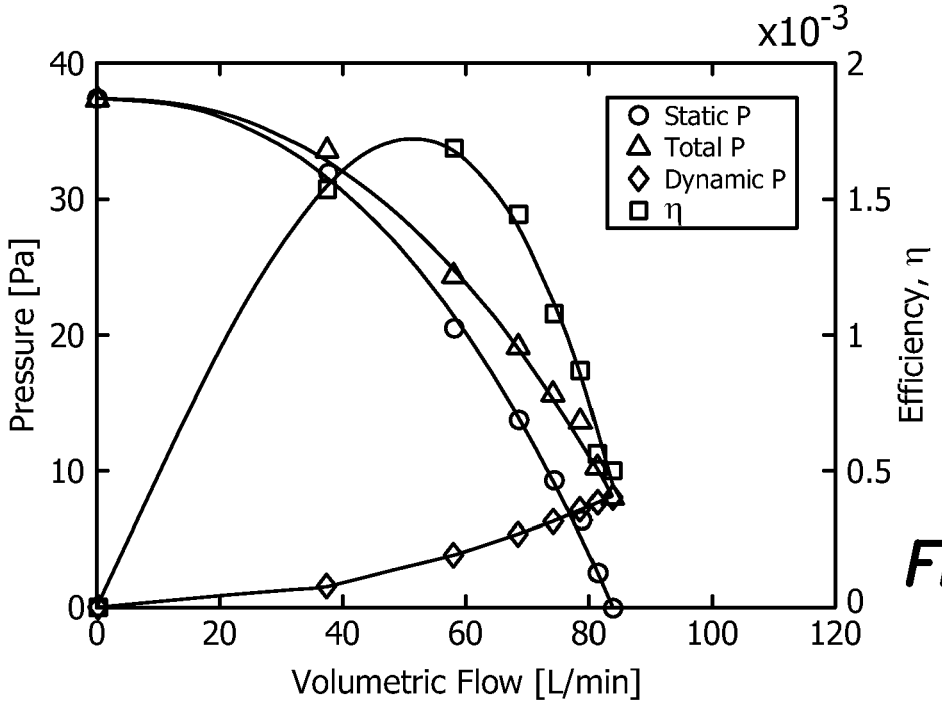
FIG. 10 is a graph of the characteristic curves of the seven stage system of the illustrated embodiment. The values of efficiency are listed as a fraction.

The total, static, and dynamic pressures are shown for the seven-stage case in the graph of FIG. 10, where the total is the sum of the static and dynamic pressures. The trends are very similar to those of conventional fans.

It has been reported in the prior art that the energy efficiency (i.e. Flow power out=Electric power in) out of a similar ion driven wind generating device was less than 1%. Though this appears poor, for small-scale airflows, the ion driven wind system efficiency may surpass conventional fan technology because electrostatic forces scale more favorably as size decreases. The energy efficiency for the staged, ion-driven wind in the absence of a nozzle is shown in FIG. 7. The efficiency, η, is defined as $$\eta = \frac{P_{output}}{P_{input}} = \frac{\frac{1}{2}\dot{m}v^2}{iV} \approx \frac{\frac{1}{2}\rho Q v_{mean}^2}{iV} \approx \frac{\frac{1}{2}\rho A v_{mean}^3}{iV},$$

where P is power, $\dot{m}$ the mass flow rate, ρ the density of air, Q the volume flow rate, $v_{mean}$ the mean air velocity, A the tube area, V the applied voltage, and i is the electrical current. In this fashion, the output power is the kinetic energy (approximately, as mean velocity values were used rather the velocity profiles integrated across the exit area). This definition of efficiency differs from that for fans because we only consider the kinetic energy of the air as output power and the flow work associated with bringing the fluid into a pressurized environment is considered lost. Our pressurized environment is limited to the region inside the nozzle 76, and the purpose of the nozzle 76 is to accelerate the fluid rather than to pump fluid from an atmospheric pressure environment into a pressurized system. The electrical current and input power ranged from 200 to 870 mA and 3 to 13 W, respectively, for one to seven stages. FIG. 10 shows the effect of nozzle loading on efficiency and the maximum values of efficiency are just over $10^{-3}$ (or 0.1%).

Therefore, methodologies for maximizing ion-driven wind velocities originating from point corona discharges and emerging from circular orifices are disclosed above. The results for an individual stage imply that the optimum design requires a sharply pointed pin, at the highest negative potential that can be achieved without electrical breakdown, to be placed axially within an insulating tube, fitted with an earthed metallic ring at a separation equal to the tube radius. Best results are obtained when the ring has no sharp edges, is cemented flush with the tube walls at its exit, and the ambient air is dehumidified. For linear arrays of multiple stages, the exit velocity increases appreciably only up to the point beyond which the back pressure aggregates in step with the driving pressure. This limitation, however, does not apply to aggregating pressure rises using many stages and terminating the assembly in a converging nozzle 76. In this respect, the characteristics of multi-staging are analogous to that of fans. Using seven stages, we have more than doubled the maximum ion-driven wind velocities reported hitherto. The overall efficiency of the process is low. However, the devices offer some advantages where modest gas flows are required, in that they are light-weight, robust, involve no moving parts and, with suitable circuitry, operate on the smallest of batteries. With reference to electrically controlled burners, for example, the velocities we have achieved are at least 20 times the maximum burning velocities of stoichiometric hydrocarbon/air mixtures.

Figure 11:
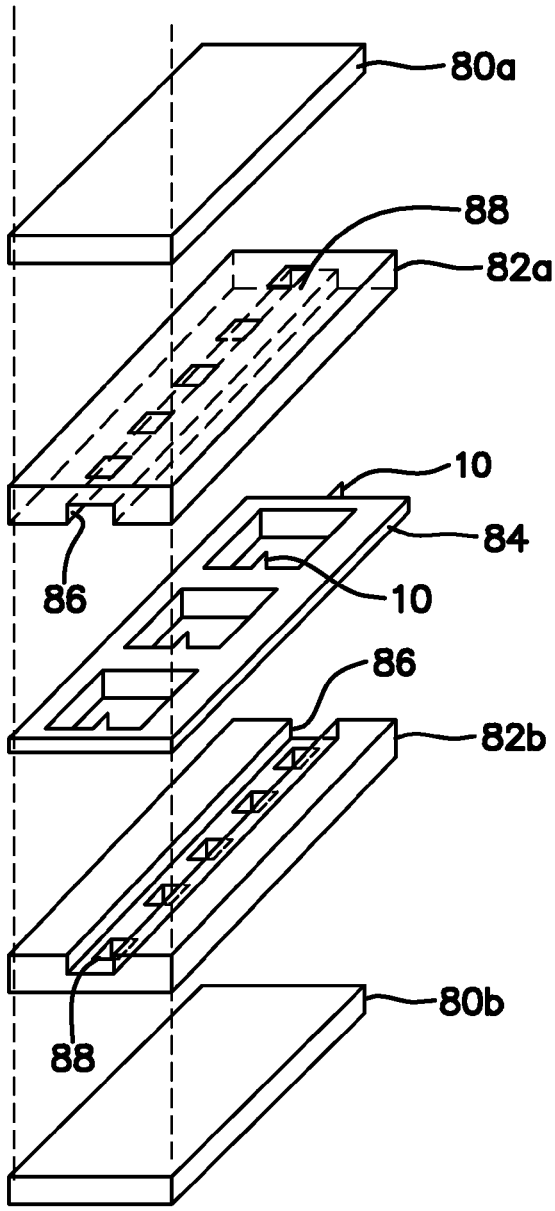
FIG. 11 is an exploded perspective view of the various layers of the multistage mesoscale system of FIG. 12, as further described in connection with FIGS. 13 and 14.

The value of the multistaged, nozzled ion wind generator, however, is not in competition with conventional fans, but in miniaturization at the micro or mesoscale. FIG. 11 is an exploded assembly diagram in perspective view of an illustrated embodiment in which a multistaged ion driven wind generator has been devised using conventional microlithographic or MEMS fabrication techniques. The illustrated embodiment is comprised of five mesoscale layers. As shown in FIG. 11 there is an upper and lower conductive ground layer 80*a* and 80*b*, which are the outer layers. Moving inward, next comes an upper and lower insulative channel layer or manifold 82*a* and 82*b*. The upper and lower insulative mesoscale channel layer 82*a* and 82*b* each have an axial or longitudinal channel 86 defined in them. Fluid or air can flow from an inlet end of channel 86 to an outlet end of channel 86. A plurality of mesoscale openings 88 defined in channel layer 82*a* and 82*b* communicate the axial channel 86 to the upper and lower conductive ground layers 80*a* and 80*b*. Finally, sandwiched between channel layer 82*a* and 82*b* there is a middle conductive electrode layer 84. A corresponding plurality of mesoscale openings or chambers 90 are defined in conductive electrode layer 84. An integrally formed mesoscale point electrode 10 extends along the longitudinal axis of each chamber 90. Each chamber 90 in layer 84 and the communicating portions in the openings defined in layers 80*a*, 80*b*, 82*a*, and 82*b* collectively define a single ion wind stage, which is communicated to an upstream and downstream identical stage through common channel 86.

Figure 12:
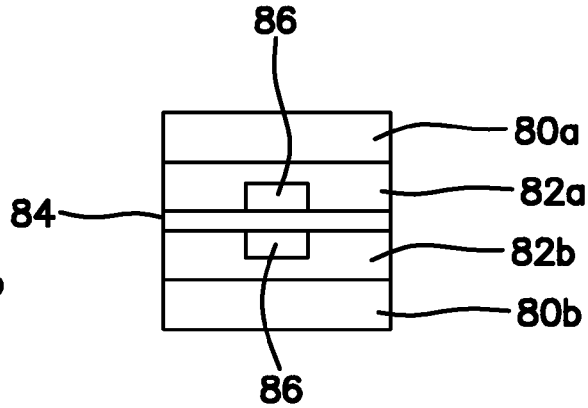
FIG. 12 is an end plan view of the assembled the multistage mesoscale system.
Figure 13:
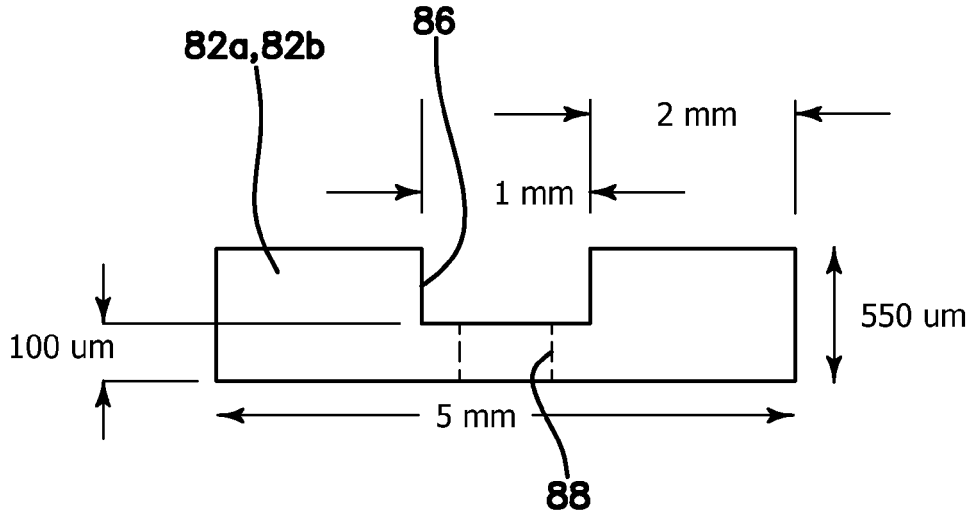
FIG. 13 is an end plan view of the insulative layer of the multistage mesoscale system of FIG. 12.
Figure 14:
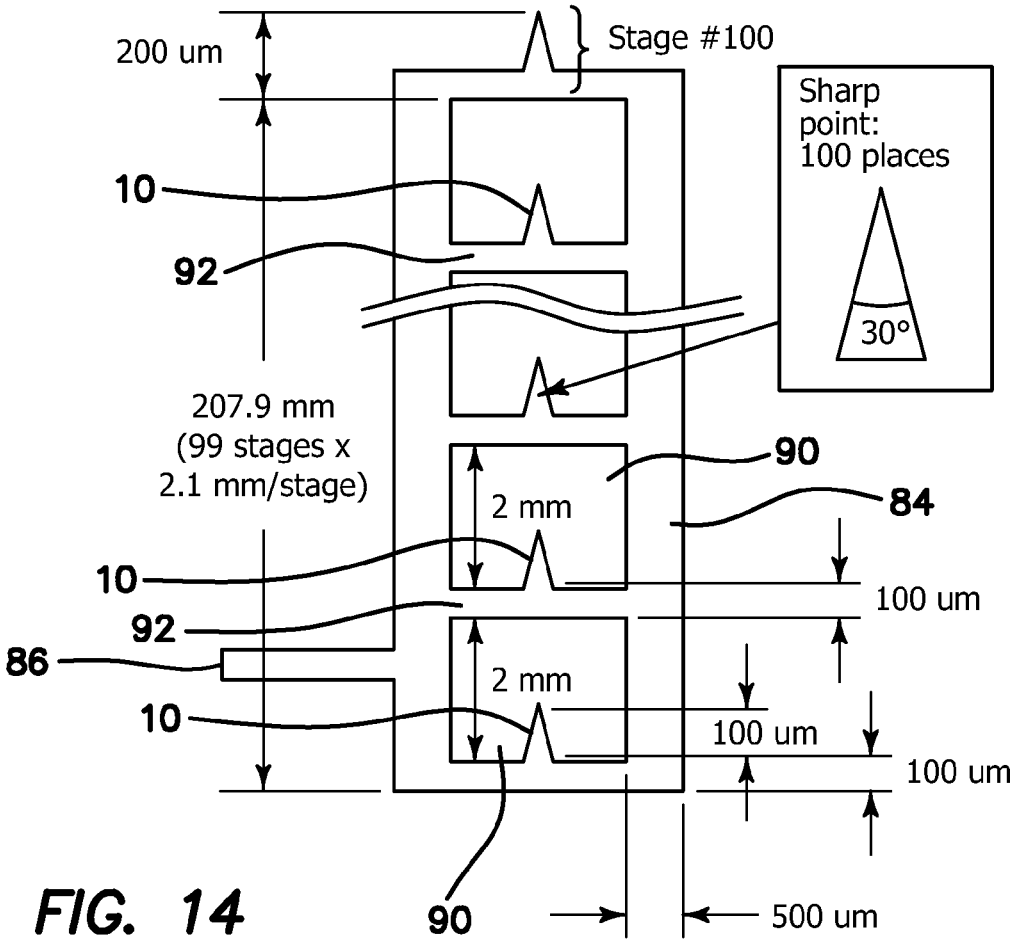
FIG. 14 is a plan view of the electrode layer of the multistage mesoscale system of FIG. 12.

More specifically, a pair of planar conductive layers 80*a* and 80*b* made of copper or other conductive material form the grounded electrodes. At the mesoscale, layers 80*a* and 80*b* may be layers 210 mm by 5 mm rectangular shapes of any thickness. Manifolds 82*a* and 82*b* are made of an insulator, such as acrylic, and have formed therein an axial channel 86 through which a plurality of openings 88 are defined, extending to expose layers 80*a* and 80*b* when assembled as shown in FIG. 12. Manifolds or channel layers 82*a* and 82*b* are shown in end plan view in FIG. 13 and in the illustrated embodiment have a center thickness at channel 86 of about 100 μm. Sandwiched between manifolds 82*a* and 82*b* is a 100 μm thick conductive electrode layer 84 in which a plurality of openings 90 are defined corresponding to the plurality of openings 88 in manifolds 82*a* and 82*b*. Each opening 90 has a corresponding 100 μm long axially extending electrode 10 which is provided with a sharp point. In the illustrated embodiment electrodes 10 are isosceles triangles with 30 degree tips. The openings 90 are approximately 2 mm long. When assembled as shown in FIG. 12 each electrode 10 is suspended in a chamber by a 100 μm arm 92 extending across the chamber collectively formed by opening 90, channel 86 and openings 88. An electrical connector 86 extends from layer 84 to allow for ease of connection to a high voltage source.

Figure 15:
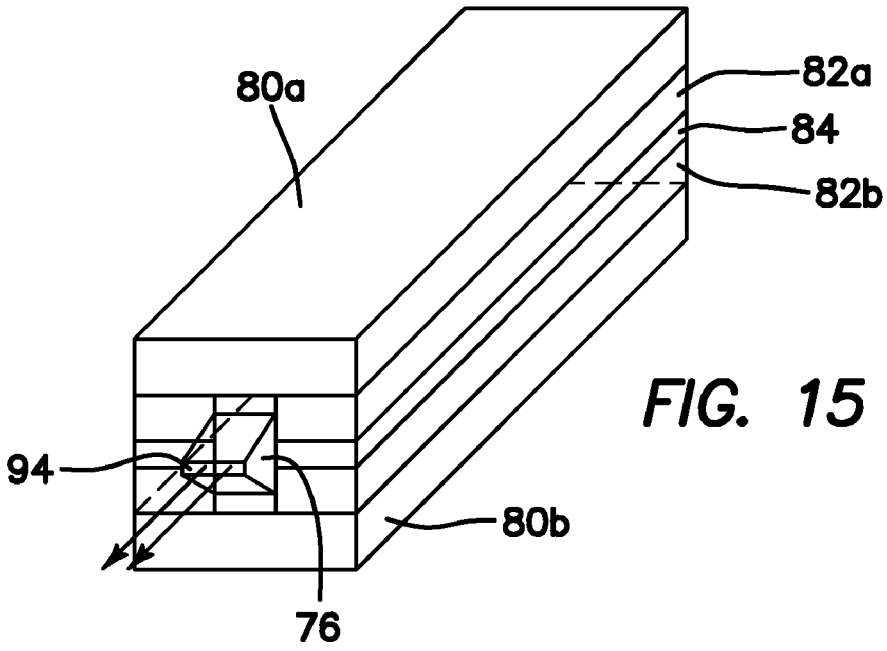
FIG. 15 is a perspective view of the multistage mesoscale system of the invention after it has been provided with an exit nozzle.

In the mesoscale embodiments described, it is clear that 100 serial stages can be provided in a system 210 mm long. FIG. 15 shows the system of FIGS. 11-14 provided with a prismatic, triangular exit nozzle 76 having its 1 mm by 1 mm inlet orifice communicated to the end of channels 86 and which is provided with an 1 mm by 0.17 mm exit orifice 94. The invention also contemplates the embodiment where nozzle 76 may be a negligibly mild contraction or narrowing.

Figure 16:
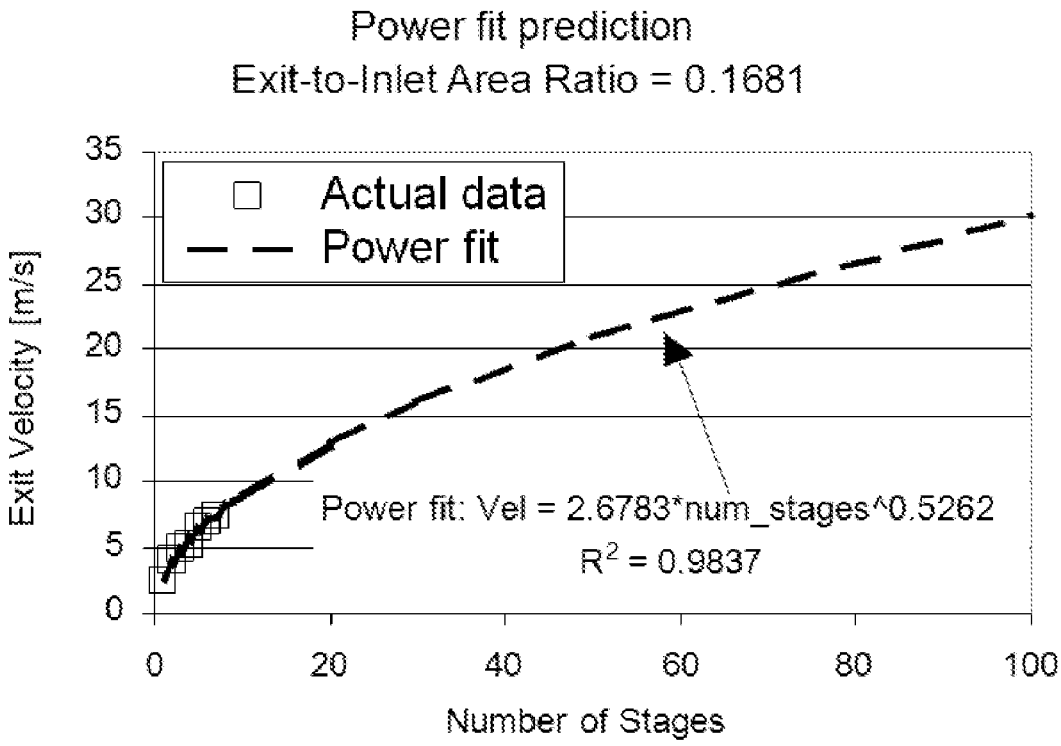
FIG. 16 is a graph of the exit velocity as a function of the number of stages employed in the mesoscale system of FIGS. 11-14.
Figure 17:
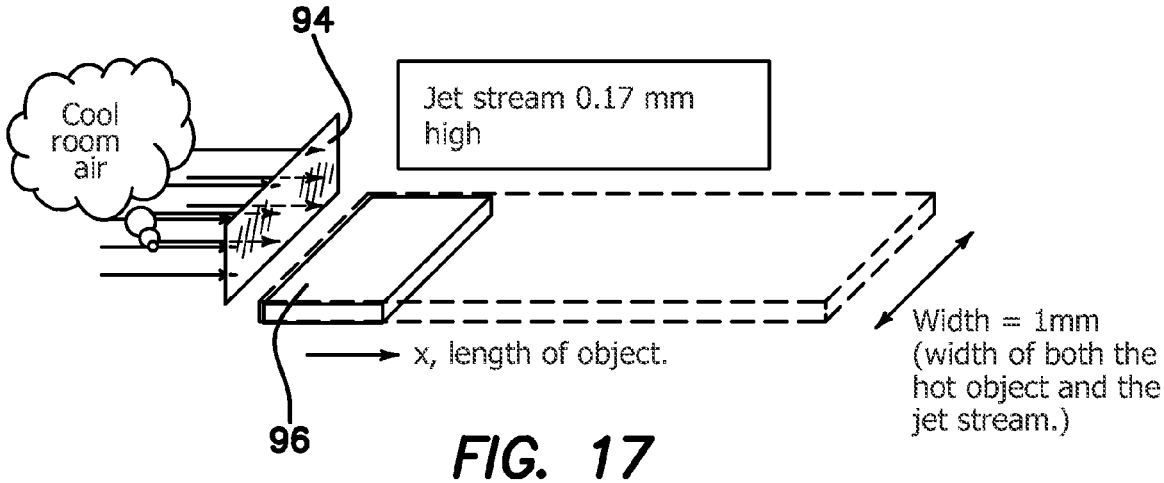
FIG. 17 is a diagram of a nozzle exit orifice position above a hot plate to produce convective cooling of the hot plate, which represents any heated object.
Figure 18:
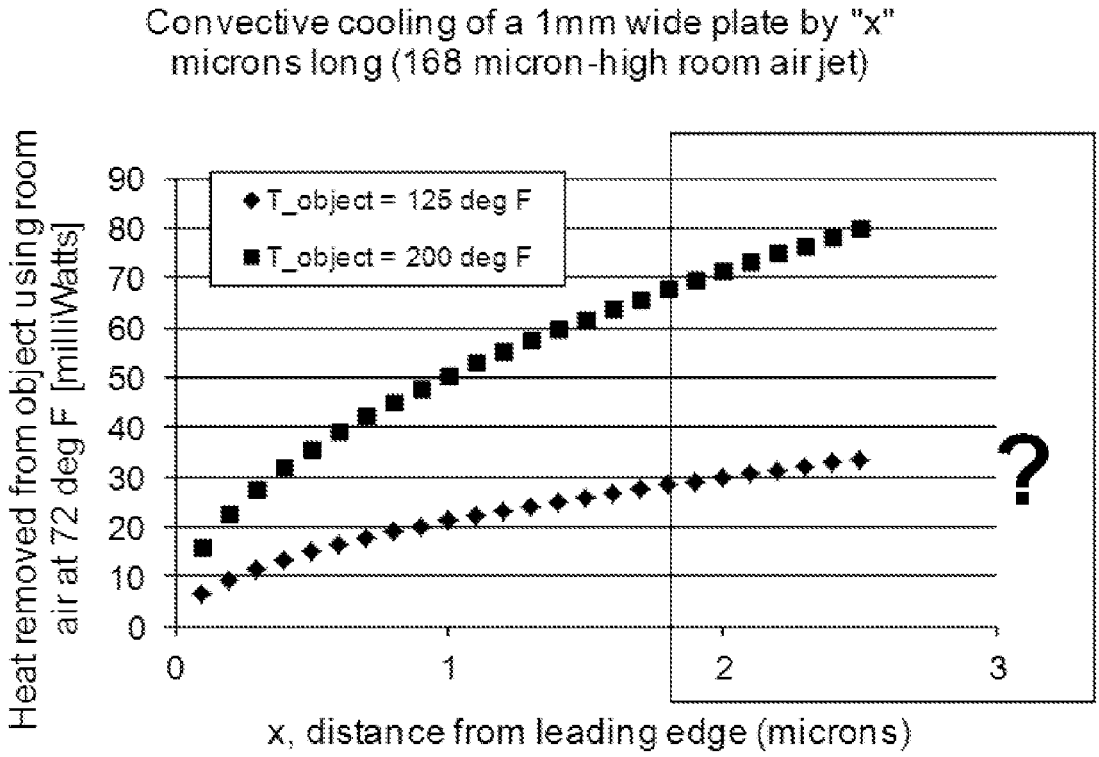
FIG. 18 is a graph of heat removed from the arrangement of FIG. 17 as a function of distance from the leading edge of the hot plate.

FIG. 16 is a graph of the mean velocity of the system shown in FIG. 15 as a function of the number of stages, showing a velocity approaching 30 m/sec. Consider a cooling application as diagrammatically shown in FIG. 17, where the nozzle 16 of the system of FIG. 15 is placed adjacent to a 1 mm wide hot plate 96 and blows a jet stream 0.17 mm high across plate 96. The predicted heat removal is shown in FIG. 18 as a function of the distance, x, from the leading edge of plate 96 using cooling air at 72° F. for a plate 96 at 125° F. and 200° F.

Therefore, it can be appreciated that what is disclosed is a staged, nozzled ionic wind generator, which can be used for convective heat transfer in miniaturized applications at the mesoscale. The illustrated embodiment shows a 100-stage unit with approximate overall dimensions of 5 mm×5 mm×210 mm, which contains a flow channel of 1 mm×1 mm. An exit nozzle has been suggested, which would produce a rectangular outlet jet that is 1 mm by 0.17 mm. The expected mean velocity of the jet is 30 m/s. If placed parallel to a 200 deg F. surface 1 mm wide by 1.7 mm deep, 65 mW will be removed by the ambient incoming air drawn through the ion-wind generator.

The geometry of the application at hand will greatly affect the design of the ion-wind generator. If a large surface is to be cooled, a steeply converging exit nozzle may or may not be advantageous. The conversion to velocity across an exit nozzle comes at a cost of reduced mass throughput. Yet, the disadvantage to larger, un-nozzled systems is the reduced cooling downstream of the location where the wind first comes in contact with the surface. This comes about because the boundary layer grows downstream and disrupts the velocity and temperature gradients normal to the surface.

Based on this last point, it may be more advantageous to utilize an array of nozzled wind generators. If an array of nozzled generators are separated by some optimum distance, the boundary layer can be continuously "reset" to zero with each additional stage. Thus, such arrays may used multiple serially staged ion driven wind generators which are arranged in parallel arrangements with the outputs directed or not by corresponding nozzles or shaped channeling orifices. Minimizing the boundary layer growth has a further advantage of reduced operating noise. Determining the optimum geometric setup is further complicated by new physical laws and empirical correlations associated with scaled down systems. We expect that the velocity gain associated with an exit nozzle will always produce more cooling than un-nozzled systems if the exit dimensions of the nozzle is larger relative to the size of the object being cooled or large relative to a "hot-spot" being targeted on a larger object.

Many alterations and modifications may be made by those having ordinary skill in the art without departing from the spirit and scope of the invention.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus for generation of ion driven wind comprising:

a plurality of ion driven wind generator stages, each coupled to each other in series, the plurality of ion driven wind generator stages having an inlet and an outlet and include in each stage a sharp axial electrode and a smooth at least partially coaxial ground electrode, wherein the plurality of stages are fabricated in a plurality of mesoscale layers in which the grounded electrode and axial electrode are defined, and where the plurality of mesoscale layers comprise:

an upper and lower conductive ground layer, an upper and lower insulative channel layer disposed adjacent to the upper and lower conductive ground layer respectively in which upper and lower insulative mesoscale channel layer an axial channel is defined and in which upper and lower insulative channel layer a plurality of mesoscale openings communicating the axial channel to the upper and lower conductive ground layers are defined, and a middle conductive electrode layer disposed adjacent to the upper and lower insulative channel layers in which middle conductive electrode layer a corresponding plurality of mesoscale chambers are defined into which an integrally formed mesoscale point electrode axially extends; and a nozzle communicated to the outlet.

2. The apparatus of claim 1 where the plurality of ion driven wind generator stages each comprise a tube housing and where the ground electrode is a ring electrode disposed in or on the tube housing.

3. The apparatus of claim 2 where the ring electrode has an inner surface flush with an inner surface of the tube housing.

4. The apparatus of claim 2 where the ring electrode comprises a flush axial extension of the tube housing.

5. The apparatus of claim 2 where a gap distance is provided between the axial electrode and ground electrode and where the gap distance is approximately equal to the diameter of the tube housing.

6. The apparatus of claim 1 wherein each axial electrode has a pin point and where each axial electrode is completely insulated except for the pin point.

7. The apparatus of claim 1 wherein the plurality of axial electrodes have an alternating voltage polarity applied to them, where each axial electrodes has a corresponding upstream coaxial electrode, and where each axial electrode is maintained at the same voltage polarity as its corresponding upstream coaxial ground electrode.

8. The apparatus of claim 1 further comprising a negative voltage source coupled to the axial electrode, the voltage source providing the highest negative potential that can be achieved without electrical breakdown.

9. The apparatus of claim 1 further comprising a source of dehumidified air coupled to the plurality of stages.

10. A method for generating ion driven wind comprising:

operating a plurality of ion driven wind generator stages in series, the plurality of ion driven wind generator stages having an inlet and an outlet;

flowing gas through each of the plurality of ion driven wind generator stages by means of an ionizing voltage applied between a sharp axial electrode and a smooth at least partially coaxial ground electrode;

fabricating the plurality of stages in a plurality of mesoscale layers in which the grounded electrode and axial electrode are defined, wherein fabricating the plurality of stages in a plurality of mesoscale layers comprise:

providing an upper and lower conductive ground layer, providing an upper and lower insulative channel layer, disposed adjacent to the upper and lower conductive ground layer respectively in which upper and lower insulative mesoscale channel layer an axial channel is defined and in which upper and lower insulative channel layer a plurality of mesoscale openings communicating the axial channel to the upper and lower conductive ground layers are defined, and providing a middle conductive electrode layer disposed adjacent to the upper and lower insulative channel layers in which middle conductive electrode layer a corresponding plurality of mesoscale chambers are defined into which an integrally formed mesoscale point electrode axially extends; and nozzling flow at the outlet.

11. The method of claim 10 where flowing gas through each stage by means of an ionizing voltage applied between a sharp axial electrode and a smooth at least partially coaxial ground electrode comprises flowing gas through a tube housing in which the ground electrode is a ring electrode is at least partially coaxially disposed.

12. The method of claim 11 where flowing gas through a tube housing in which the ground electrode is a ring electrode comprises flowing gas through a tube housing in which the ring electrode has an inner surface flush with an inner surface of the tube housing.

13. The method of claim 11 where flowing gas through a tube housing comprises flowing gas through the ring electrode which is a flush axial extension of the tube housing.

14. The method of claim 11 where a gap distance is provided between the axial electrode and ground electrode and where operating the plurality of ion driven wind generator stages comprises providing a gap distance approximately equal to the diameter of the tube housing.

15. The method of claim 10 where operating the plurality of ion driven wind generator stages comprises providing each axial electrode with a pin point and completely insulating the axial electrode except for the pin point.

16. The method of claim 10 where operating the plurality of ion driven wind generator stages comprises applying an alternating voltage polarity to the plurality of axial electrodes, providing each axial electrodes has a corresponding upstream coaxial electrode, and maintaining each axial electrode at the same voltage polarity as its corresponding upstream coaxial ground electrode.

17. The method of claim 10 further comprising applying a negative voltage source coupled to the axial electrode at the highest negative potential that can be achieved without electrical breakdown.

18. The method of claim 10 further comprising providing dehumidified air to the plurality of stages.

* * * * *